United States Patent [19]

Sheaffer et al.

[11] Patent Number: 4,481,911

[45] Date of Patent: Nov. 13, 1984

[54] STRATIFIED-CHARGE CROSS-FLOW SCAVENGED TWO-STROKE CYCLE ENGINE

[75] Inventors: Benjamin L. Sheaffer, Oshkosh; John M. Griffiths, Fond du Lac, both of Wis.

[73] Assignee: Brunswick Corporation, Skokie, Ill.

[21] Appl. No.: 566,676

[22] Filed: Dec. 29, 1983

[51] Int. Cl.[3] ..... F24B 13/04; F02B 33/04

[52] U.S. Cl. ..... 123/73 R; 123/73 A; 123/73 B; 123/DIG. 4; 123/432; 123/433

[58] Field of Search ..... 123/73 R, 73 A, 73 B, 123/DIG. 4, 433, 432, 575, 585

[56] References Cited

U.S. PATENT DOCUMENTS

| | | | |
|---|---|---|---|
| 1,664,091 | 3/1928 | Sinclair | 123/DIG. 4 |
| 1,947,375 | 2/1934 | Broderson | 123/DIG. 4 |
| 2,249,354 | 7/1941 | Gehres | 123/DIG. 4 |
| 4,075,985 | 2/1978 | Iwai . | |
| 4,253,433 | 3/1981 | Blair . | |
| 4,317,432 | 3/1982 | Noguchi et al. | 123/432 X |

FOREIGN PATENT DOCUMENTS

| | | | |
|---|---|---|---|
| 2347809 | 4/1975 | Fed. Rep. of Germany | 123/DIG. 4 |
| 2756794 | 6/1978 | Fed. Rep. of Germany | 123/DIG. 4 |

OTHER PUBLICATIONS

"Zweitakt-Gemischspülung mit Spülvorlage", by Dr.-Ing. Kurt Blume, Galβach, *MTZ Motortechnische Zeitschrift*, 74, (1972), pp. 475-479.

*Primary Examiner*—Wendell E. Burns

*Attorney, Agent, or Firm*—Andrus, Sceales, Starke & Sawall

[57] ABSTRACT

A stratified-charge cross-flow scavenged two-stroke cycle spark-ignition engine (1) includes a piston (2) having a raised crown (6) with a baffle (7) and chamfered sides (8, 9) and reciprocal in a cylinder (3) between a combustion chamber (4) and a crankcase (5). Transfer passage structure is disclosed wherein a pair of elongated scavenging air passages (17, 18) extend between the crankcase and combustion chamber on opposite sides of a shorter fuel-air transfer passage (11). A pair of scavenging air inlet ports (20, 21) in the combustion chamber are adjacent the fuel-air inlet port (12) therebetween and substantially distally opposite the exhaust port (16). The scavenging air inlet ports face the baffle at its edges along the chamfered sides of the piston crown.

12 Claims, 3 Drawing Figures

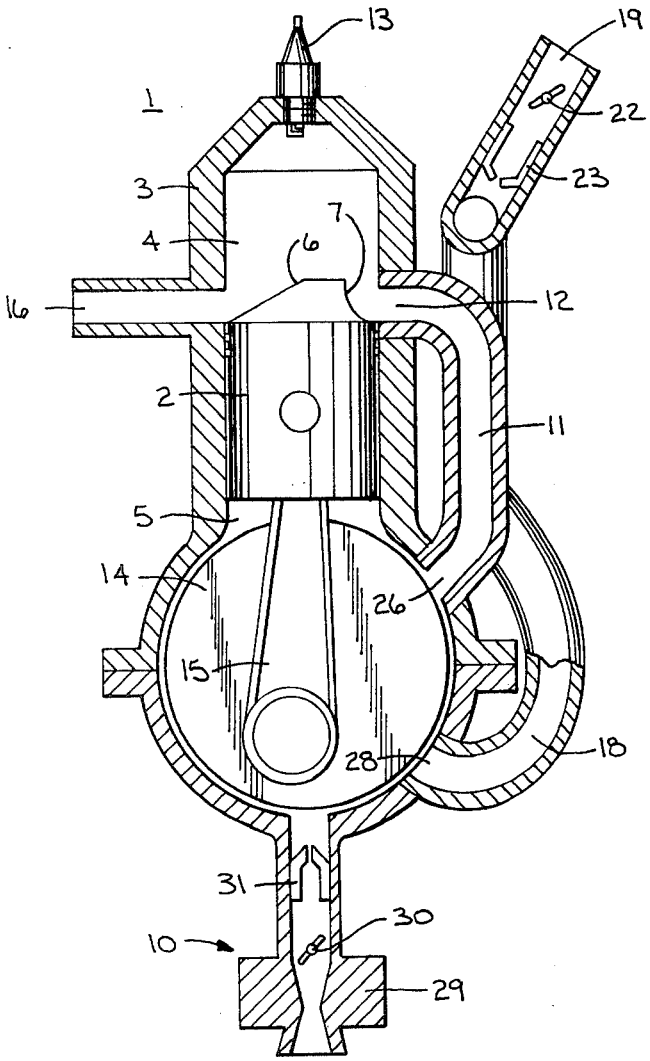
FIG.1
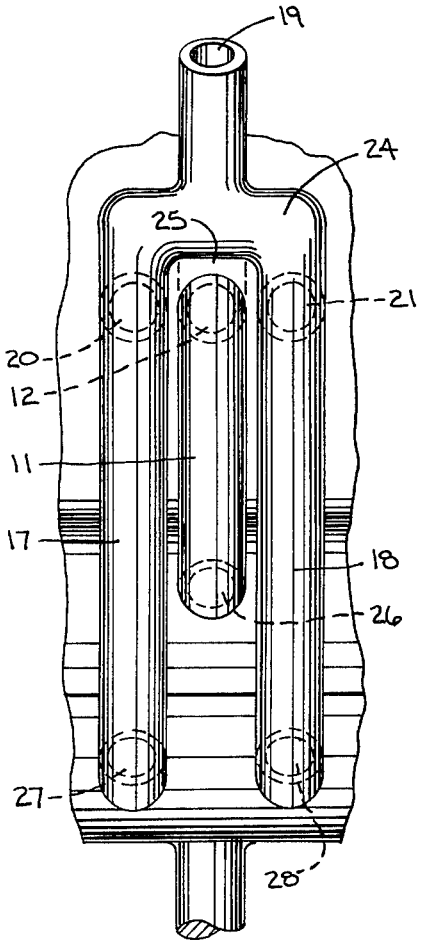
FIG.2
FIG.3
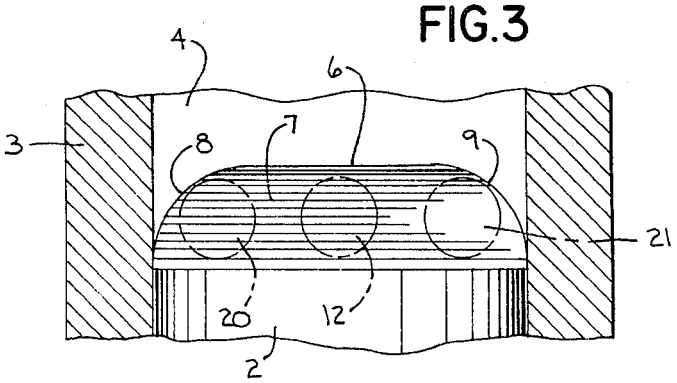

STRATIFIED-CHARGE CROSS-FLOW SCAVENGED TWO-STROKE CYCLE ENGINE

DESCRIPTION

1. Technical Field

The invention relates to a stratified-charge cross-flow scavenged two-stroke cycle spark-ignition engine. One application is marine propulsion systems.

2. Background

In a cross-flow two-stroke cycle engine, the piston has a raised crown with a curved deflection shoulder or baffle facing the fuel-air mixture inlet port to redirect the incoming mixture into the cylinder. This is in contrast to a loop scavenged engine having a flat or spherical piston crown.

In a cross-flow engine, the piston crown also has chamfered sides extending from the tip of the crown at the edges of the baffle. The exhaust port is approximately 180° opposite the fuel-air inlet port. During the scavenging downstroke of the piston, the incoming fuel mixture expels combustion products out the exhaust port, with the baffle on the piston crown preventing short circuiting thereacross of the incoming fuel mixture. However, there is some short circuiting to the exhaust port of unburned fuel mixture across the ends of the baffle along the chamfered sides of the crown adjacent the peripheral cylinder wall.

Shaping the baffle edges to prevent the mixture from flowing thereacross is not an acceptable solution because of interference problems with the combustion chamber. The baffle is thus normally chamfered at the edges. In some applications, a fairly large chamfer is necessary in order to prevent the baffle from causing pre-ignition.

DISCLOSURE OF THE INVENTION

A scavenging air system provides air inlet means in the combustion chamber proximate the chamfered side of the piston crown. A pair of elongated air passages have air inlet ports facing the edges of the crown baffle at the chamfered sides. The air inlet ports are on opposite sides of and adjacent the fuel-air mixture inlet port and substantially distally opposite the exhaust port.

BRIEF DESCRIPTION OF THE DRAWINGS

FIG. 1 is a schematic sectional view of a cross-flow two-stroke cycle engine constructed in accordance with the invention.

FIG. 2 is a side view showing the preferred passage network.

FIG. 3 is an isolated sectional side view showing the passage inlet ports in the cylinder facing the piston crown.

BEST MODE FOR CARRYING OUT THE INVENTION

A stratified-charge cross-flow scavenged two-stroke cycle spark-ignition engine 1, includes a piston 2 reciprocal in a cylinder 3 between a combustion chamber 4 and a crankcase 5. Piston 2 has a raised crown 6 with a curved deflection shoulder or baffle 7 and chamfered sides 8 and 9, at the edges of the baffle. A fuel supply system is provided for supplying fuel to crankcase 5. A fuel-air transfer passage 11 extends between crankcase 5 and a fuel-air inlet port 12 in combustion chamber 4. During the upstroke of piston 2, the fuel-air mixture is compressed in chamber 4, and upon ignition of spark plug 13 combustion of the mixture drives piston 2 downwardly to rotate crankshaft 14 through connecting rod 15. The combustion products exit through exhaust port 16.

A plurality of transfer passages such as 11, 17 and 18 extend between crankcase 5 and combustion chamber 4. These passages include the fuel-air transfer passage 11 extending between crankcase 5 and fuel-air inlet port 12 in combustion chamber 4 facing baffle 7 of piston crown 6 and approximately 180° opposite exhaust port 16. The transfer passages further include air passages 17 and 18 having an input 19 for receiving external air and extending between crankcase 6 and respective air inlet ports 20 and 21 in combustion chamber 4 proximate respective chamfered sides 8 and 9 of pistion crown 6.

Air inlet ports 20 and 21 face baffle 7 of the piston crown. Air inlet ports 20 and 21 are adjacent fuel-air inlet port 12 therebetween. The three ports 20, 12 and 21 are substantially distally opposite exhaust port 16.

External air input 19 is an air throttle, including butterfly valve 22 and one-way reed valve 23, connected to the pair of air passages 17 and 18 by bridging passage 24 therebetween. In one embodiment, air is inducted through input 19 only to the outside transfer passages 17 and 18. In another embodiment, air is also inducted into central transfer passage 11 as shown at 25. In the latter embodiment, the amount of air introduced into central passage 11 may be limited by an orifice or valve so that the first portion of a charge entering the cylinder from that passage is air, and as the scavenging progresses, fuel-air mixture is introduced to the central passage.

Air transfer passages 17 and 18 each have a length between crankcase 5 and respective air inlet ports 20 and 21 substantially great enough to reduce fuel mixture therein and afford substantially only air at the respective air inlet ports 20 and 21 to in turn short circuit along respective chamfered sides 8 and 9 of piston crown 6 to exhaust port 16 in substitution for unburned fuel mixture from port 12. The greater the length of passages 17 and 18 between crankcase 5 and combustion chamber 4 the lesser the amount of fuel and the greater the amount of air at ports 20 and 21. This greater amount of air reduces the amount of unburned fuel mixture from ports 20 and 21 otherwise lost to exhaustion, and also substitutes for more of the unburned fuel mixture from port 20 otherwise lost to exhaustion. Fuel-air transfer passage 11 extends from crankcase 5 at a port 26 adjacent piston 2 and has a length approximately equal to the height of piston 2. Air passages 17 and 18 extend from crankcase 5 at ports 27 and 28 substantially distally removed from piston 2. The length of air passages 17 and 18 between respective ports 27 and 20, and 28 and 21, is substantially greater than the length of fuel-air transfer passage 11. The length of passage 11 is approximately equal to the height of piston 2.

Fuel supply means 10 comprises carburetor means 29, including butterfly valve 30 and one-way reed valve 31, mounted to crankcase 5 substantially coaxially with piston 2 to enable narrow engine design. By supplying the fuel into the crankcase, there is better mixing of fuel and air because the fuel goes into a hot crankcase and is stirred up by the crankshaft and connecting rods to provide better atomization and vaporization. In an alternative, the carburetor could be located on top of the short transfer passage 11, in which case the fuel mixture would flow down the short passage into the crankcase and afford the noted atomization and vaporization. In each case, no lubrication pump is required because the fuel-oil mixture is supplied to the crankcase.

The carbureted cross-flow scavenged engine with reduced fuel comsumption thus provides short circuiting of substantially only air from the outside transfer passages to the exhaust port distally opposite thereto. Such engine is particularly useful in low cost low horsepower engine applications.

We claim:

1. A stratified-charge cross-flow scavenged two-stroke cycle spark-ignition engine comprising a piston having a raised and chamfered crown with a baffle and reciprocal in a cylinder between a combustion chamber and a crankcase, means for supplying fuel to said crankcase, an exhaust port in said combustion chamber, a plurality of transfer passages between said crankcase and said combustion chamber including a fuel-air transfer passage between said crankcase and a fuel-air inlet port in said combustion chamber facing said baffle on said piston crown and approximately 180° opposite said exhaust port, air passage means having an input for receiving external air and extending between said crankcase and air inlet port means in said combustion chamber proximate said chamfered crown.

2. The invention according to claim 1 wherein said air inlet port means is adjacents said fuel-air inlet port and substantially distally opposite said exhaust port.

3. The invention according to claim 2 wherein said external air input also supplies air to said fuel-air transfer passage.

4. A stratified-charge cross-flow scavenged two-stroke cycle spark-ignition engine comprising a piston having a raised crown with a baffle and chamfered sides and reciprocal in a cylinder between a combustion chamber and a crankcase, means for supplying fuel to said crankcase, an exhaust port in said combustion chamber, a fuel-air transfer passage between said crankcase and a fuel-air inlet port in said combustion chamber facing said baffle on said piston crown and approximately 180° opposite said exhaust port, a pair of air passages on opposite sides of said fuel-air transfer passage and extending between said crankcase and a pair of air inlet ports in said combustion chamber on opposite sides of said fuel-air inlet port and proximate opposing said chamfered sides of said piston crown, and external air input means connected to said pair of air passages.

5. The invention according to claim 4 wherein said enternal air input means comprises a bridging passage connected between said pair of air passages, and an external air input port connected to said bridging passage.

6. The invention according to claim 5 wherein said bridging passage is also connected to said fuel-air transfer passage.

7. The invention according to claim 4 wherein said air inlet ports face the edges of said baffle at said chamfered sides.

8. The invention according to claim 7 wherein said pair of air inlet ports are adjacent said fuel-air inlet port therebetween and substantially distally opposite said exhaust port.

9. The invention according to claim 8 wherein in said air passages each have a length between said crankcase and said air inlet ports substantially great enough to reduce fuel mixture therein and afford substantially only air at said air inlet ports to short circuit along said chamfered sides of said piston crown to said exhaust port in substitution for unburned fuel mixture from said fuel-air inlet port.

10. The invention according to claim 9 wherein each of said pair of air passages has a length substantially greater than that of said fuel-air transfer passage.

11. The invention according to claim 10 wherein said fuel-air transfer passage extends between said crankcase at a port adjacent said piston and said fuel-air inlet port in said combustion chamber and has a length approximately equal to the height of said piston, and said pair of air passages extend between said crankcase at ports distally removed from said piston and said air inlet ports in said combustion chamber and each has a length substantially greater than said height of said piston.

12. The invention according to claim 8 wherein said fuel supply means comprises carburetor means mounted to said crankcase substantially coaxially with said piston.

* * * * *